US006984790B1

(12) United States Patent
Bernstorf et al.

(10) Patent No.: US 6,984,790 B1
(45) Date of Patent: Jan. 10, 2006

(54) INSULATOR SEALING AND SHIELDING COLLAR ASSEMBLY

(75) Inventors: Robert A. Bernstorf, Wadsworth, OH (US); Bastiaan H. Van Besouw, Strongsville, OH (US); Edward M. Nyszczy, Stow, OH (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/115,412

(22) Filed: Apr. 27, 2005

(51) Int. Cl.
*H01B 17/42* (2006.01)

(52) U.S. Cl. ..... 174/140 R; 174/140 CR

(58) Field of Classification Search ..... 174/140 CR, 174/140 R, 144
See application file for complete search history.

(56) References Cited

U.S. PATENT DOCUMENTS 1,799,977 A * 4/1931 Fortescue ..... 174/144
2,867,682 A 1/1959 Smith
3,239,600 A 3/1966 Bethea, Jr.
4,198,538 A 4/1980 Lusk
5,214,249 A * 5/1993 Goch et al. ..... 174/179
5,488,199 A 1/1996 Selsing
5,570,264 A * 10/1996 Lundquist et al. ..... 361/127
5,705,775 A * 1/1998 Ishihara et al. ..... 174/140 CR
6,265,669 B1 7/2001 Richards
6,388,197 B1 5/2002 Zhao

FOREIGN PATENT DOCUMENTS

JP 07272573 10/1995

* cited by examiner

*Primary Examiner*—Dean A. Reichard
*Assistant Examiner*—Adolfo Nino
(74) *Attorney, Agent, or Firm*—Marcus R. Mickney; Alfred N. Goodman; Mark S. Bicks

(57) ABSTRACT

A collar assembly for an insulator assembly has first and second members secured together on the insulator assembly. The first member has first and second fastener holes and a first opening. The second member is connected to the first member, and has third and fourth fastener holes aligned with the first and second fastener holes, respectively. A second opening is formed in the second member. The first and second openings are adapted to receive a sealant. A first fastener is inserted through the first and third fastener holes and a second fastener is inserted through the fourth and second fastener holes to secure the first member to the second member on the insulator assembly.

20 Claims, 6 Drawing Sheets

INSULATOR SEALING AND SHIELDING COLLAR ASSEMBLY

FIELD OF THE INVENTION

The present invention relates to a collar assembly for an insulator. More specifically, the present invention relates to an insulator sealing and shielding collar assembly. Still more particularly, the present invention relates to a collar assembly having two members, and a sealant injectable in one member after both members of the collar assembly have been secured to an insulator. The collar assembly is easily installed, provides a seal for the insulator, and substantially eliminates corona discharge.

BACKGROUND OF THE INVENTION

Electrical polymer insulators are used in power transmission and distribution systems to provide mechanical support for the conductors and provide electrical insulation between the high voltage conductors and grounded tower structures. A corona protection device is located at the line end and/or the ground end of the insulator and eliminates the corona discharge from the insulator. Elimination of the corona discharge protects the surface of the insulator from polymeric material deterioration caused by electric stress. Additionally, eliminating the corona discharge reduces television and/or radio noise created by the corona discharge.

A problem with existing corona protection devices is the number of parts required to assemble the corona protection device, thereby increasing the manufacturing costs. Additionally, more parts must be carried to a job site by an installer, which decreases the speed and efficiency with which the corona protection devices may be installed. Since existing corona protection devices require various parts to completely assemble the device, if one part is lost or missing the device cannot be properly assembled and an installer must make a return trip to finish installation of the corona discharge device. A need then exists for a collar assembly having few parts, thereby reducing manufacturing costs and providing quick installation.

Other problems with existing corona protection devices involve poor seals being formed between the corona protection device and the insulator, as well as the corona protection device being poorly secured to the insulator. Poor seals with and connections to the insulators result in a highly ineffective corona protection device, and often results in the corona protection device failing. Thus, a need exists for a collar assembly having a good seal and connection to the insulator.

Examples of conventional corona protection devices include U.S. Pat. No. 2,867,682 to Smith et al.; U.S. Pat. No. 3,239,600 to Bethea, Jr.; U.S. Pat. No. 4,198,538 to Lusk; U.S. Pat. No. 5,488,199 to Selsing et al.; U.S. Pat. No. 6,265,669 to Richards; U.S. Pat. No. 6,388,197 to Zhao et al.; the subject matter of each of which is hereby incorporated by reference.

A need exists for an improved insulator collar assembly.

SUMMARY OF THE INVENTION

Accordingly, an object of the present invention is to provide an improved collar assembly for an insulator.

Another object of the present invention is to provide a collar assembly that is quickly and easily connected to an insulator.

Another further object of the present invention is to provide a collar assembly having fewer parts, thereby reducing manufacturing costs and increasing installation efficiency.

Yet another object of the present invention is to provide a collar assembly in which a strong seal and connection are formed between the collar assembly and insulator.

The foregoing objects are basically attained by providing a collar assembly for an insulator assembly having first and second members secured together on the insulator assembly. The first member has first and second fastener holes and a first opening. The second member is connected to the first member, and has third and fourth fastener holes aligned with the first and second fastener holes, respectively. A second opening is formed in the second member. The first and second openings are adapted to receive a sealant. A first fastener is inserted through the first and third fastener holes and a second fastener is inserted through the fourth and second fastener holes to secure the first member to the second member on the insulator assembly.

The foregoing objects are further attained by providing a method of installing a collar assembly on an insulator assembly. A first member having first and second fastener holes and a first opening is disposed on the insulator assembly. A second member is connected to the first member on the insulator assembly. The second member has third and fourth fastener holes aligned with the first and second fastener holes, respectively, and a second opening. A first fastener is inserted through the second and third fastener holes of the first and second members on the insulator assembly. A second fastener is inserted through the fourth and first fastener holes of the first and second members on the insulator assembly. A sealant is injected through the first opening to fill the cavity formed between inner surfaces of the first and second members and an outer surface of the insulator assembly. The first and second openings are in fluid communication with the cavity.

The foregoing objects are also attained by providing an insulator assembly having a rubber housing, a metal fitting and a collar assembly. The rubber housing has a first end. The metal fitting has a first end. The first end of the rubber housing is disposed in the first end of the metal fitting. A collar assembly is disposed over the first ends of the rubber housing and the metal fitting. The collar assembly has an annular rib engaging a groove proximal the first end of the metal fitting and a lip engaging the rubber housing proximal the first end thereof. A cavity is defined by an inner surface of the collar assembly and an outer surface of the metal fitting and the rubber housing between the annular rib and the lip. A sealant is injected through the collar assembly to fill the cavity to create a seal between the collar assembly, the metal fitting and the rubber housing.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings that form a part of this disclosure.

Throughout the drawings, like reference numerals will be understood to refer to like parts, components and structures.

DETAILED DESCRIPTION OF THE INVENTION

Figure 1:
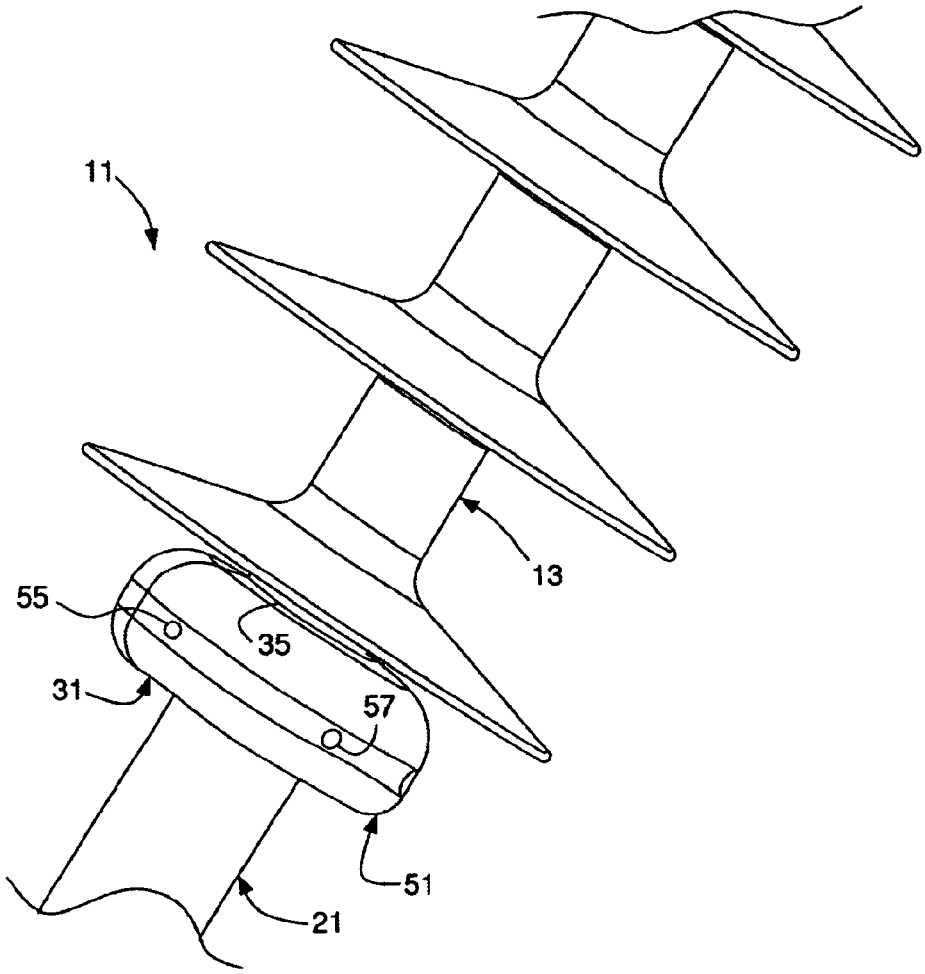
FIG. 1 is a perspective view of a collar assembly secured to an insulator assembly according to an embodiment of the present invention.

Referring to FIGS. 1–8, a collar assembly 31 is provided for an insulator assembly 11. The collar assembly has first and second members 41 and 51 secured together on the insulator assembly 11. The first member 41 has first and second fastener holes 43 and 45 and a first opening 47. The second member 51 is connected to the first member 41, and has third and fourth fastener holes 53 and 55 aligned with the first and second fastener holes 43 and 45, respectively. A second opening 57 is formed in the second member 51. The first and second openings 47 and 57 are adapted to receive a sealant 61. A first fastener 81 is inserted through the first and third fastener holes 43 and 53 and a second fastener 83 is inserted through the fourth and second fastener holes 55 and 45 to secure the first member 41 to the second member 51 on the insulator assembly 11.

Figure 2:
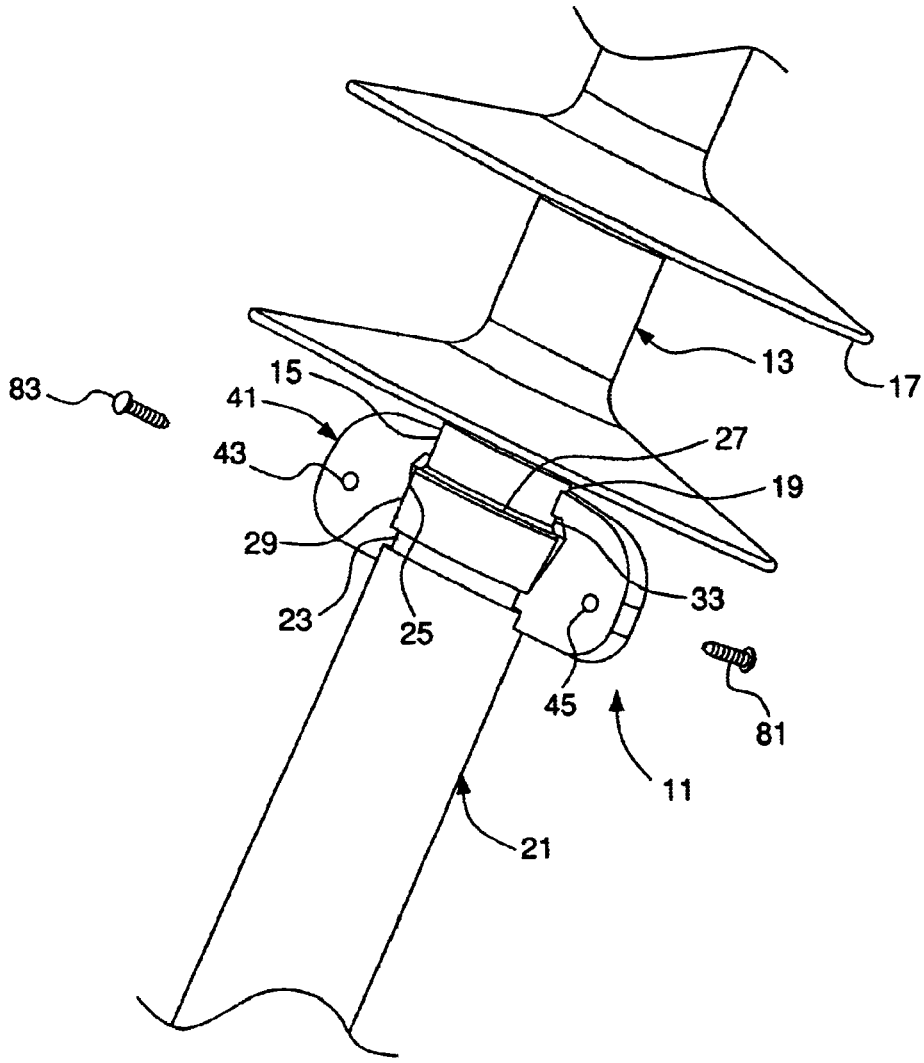
FIG. 2 is a perspective view of a first member of a collar assembly of FIG. 1 disposed on an insulator assembly.

A conventional metal fitting 21 has an opening 27 at a first end 25, as shown in FIG. 2. A groove 23 is disposed in an outer surface 29 of the metal fitting proximal the first end 25.

A conventional rubber housing 13 having a plurality of weathersheds 17 is adapted to be inserted in the opening 27 in the first end 25 of the metal fitting 21, as shown in FIG. 2. A first end 15 of the rubber housing 13 is preferably tapered to facilitate a compression fit with the metal fitting 21. Preferably, an O-ring (not shown) is disposed on the tapered end of the rubber housing 13 to create a seal between an outer surface 19 of the rubber housing and an inner surface of the metal fitting 21.

Figure 3:
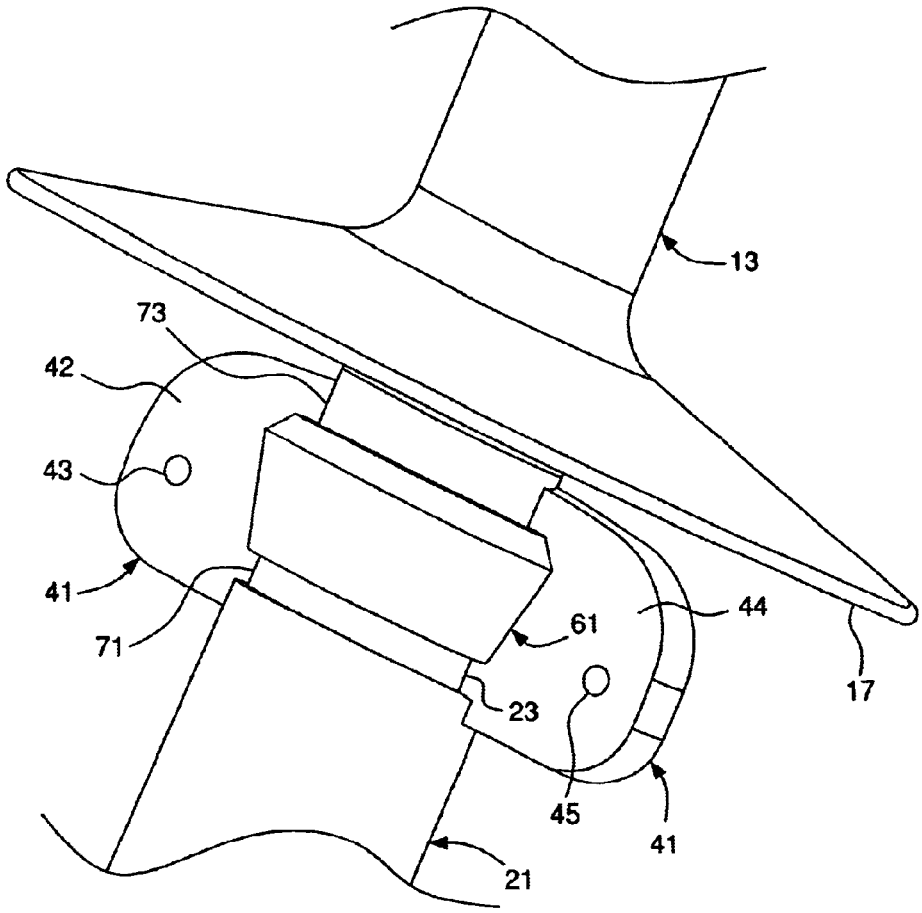
FIG. 3 is a perspective view of a collar assembly disposed on an insulator assembly in which a sealant has been injected and a second member of the collar assembly has been removed thereafter.
Figure 4:
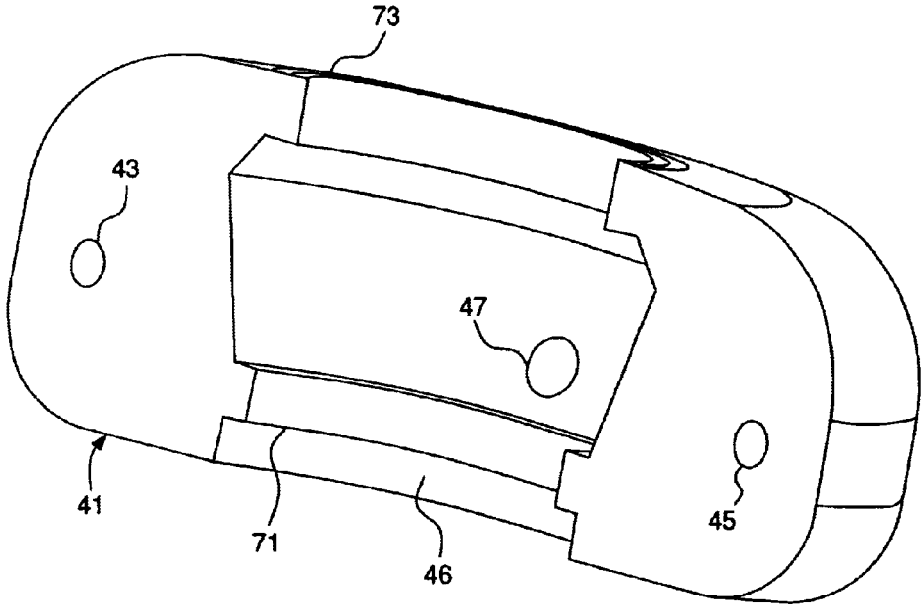
FIG. 4 is a perspective view of a first member of a collar assembly of FIG. 2.

The collar assembly 31 is disposed over the interface between the metal fitting 21 and the rubber housing 13, as shown in FIGS. 1–3. The collar assembly 31 is preferably substantially annular, as shown in FIG. 1. First and second members 41 and 51 are secured together to form the collar assembly 31. An aperture 35 in the collar assembly is adapted to receive the insulator assembly 11.

Figure 5:
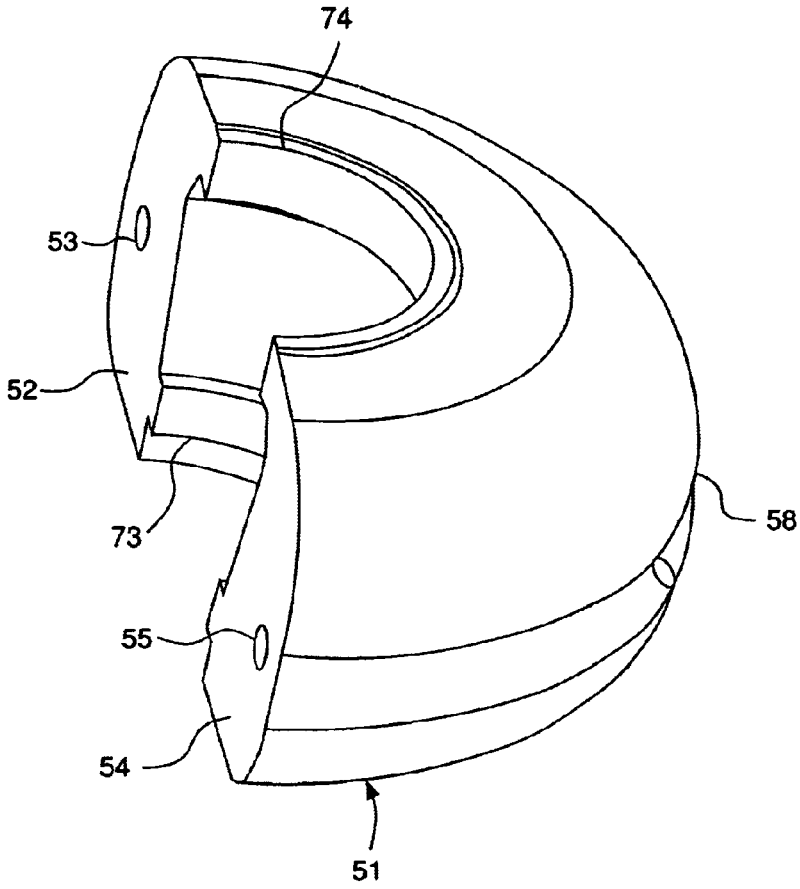
FIG. 5 is a perspective view of a second member of a collar assembly of FIG. 1.
Figure 6:
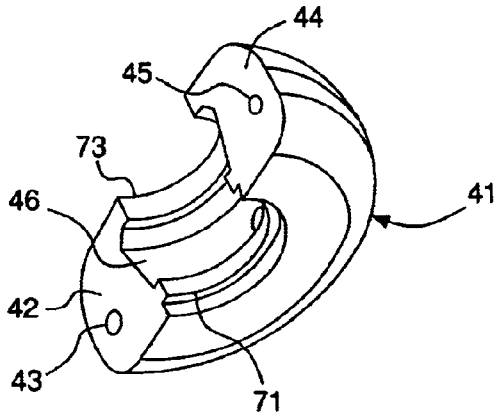
FIG. 6 is a front perspective view of a first member of a collar assembly.
Figure 7:
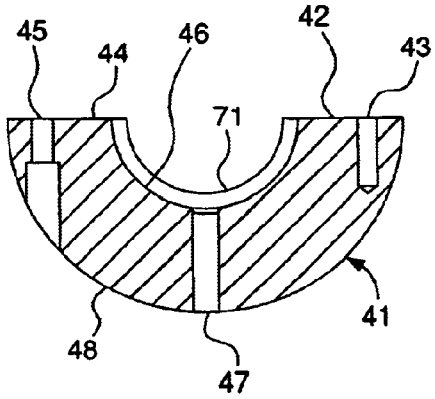
FIG. 7 is a top plan view in cross section of a first member of a collar assembly taken along a longitudinal line through first and second fastener holes of FIG. 6.
Figure 8:
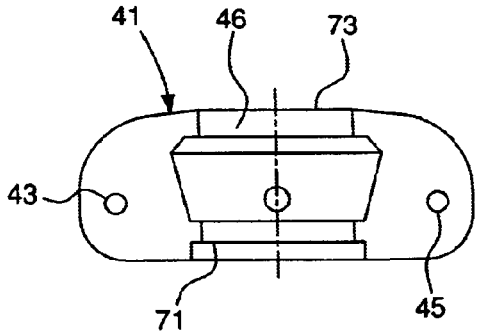
FIG. 8 is a front elevational view of the first member of the collar assembly of FIG. 6.

The first member 41, as shown in FIGS. 2–4 and 6–8, is preferably substantially arcuate. Preferably, the second member 51 is substantially similar to the first member 41, as shown in FIG. 5. First and second end faces 42 and 44 of the first member are substantially planar and are adapted to abut corresponding third and fourth end faces 52 and 54 of the second member 51. An inner surface 46 extends between the inner edges of the first and second faces 42 and 44. An outer surface 48 extends between the outer edges of the first and end second faces 42 and 44. A first rib 71 extends outwardly from the inner surface 46 between the inner edges of the first and second end faces 42 and 44 of the first member 41. The first rib 71 is adapted to be received by the groove 23 in the metal fitting, as shown in FIG. 2. A first lip 73 extends outwardly from the inner surface 46 between the first and second end faces 42 and 44. The first lip 73 is adapted to engage the outer surface 19 of the rubber housing 13, as shown in FIG. 2. Preferably, the first lip 73 is flush with an upper portion of the outer surface 48 of the first member, as shown in FIGS. 6 and 8.

A first fastener hole 43 is disposed in the first end face 42. Preferably, the first fastener hole 43 is threaded and ends within the first member such that the first fastener hole is inaccessible from the outer surface 48 of the first member, as shown in FIG. 7.

A second fastener hole 45 is disposed in the second end face 44. Preferably, the second fastener hole 45 is counter-bored, as shown in FIG. 7. The second fastener hole 45 has an opening in the outer surface 48 and in the second end face 44 such that the second fastener hole is accessible with a fastener when the first and second members 41 and 51 are disposed on an insulator assembly. The counter-bore limits insertion of the fastener in the second fastener hole.

A first opening 47 in the first member 41 extends from an outer surface 48 to the inner surface 46, as shown in FIG. 7. The first opening 47 is adapted to receive a sealant to fill a cavity 33 formed when the first and second members are connected on an insulator assembly 11.

Preferably, the second member 51 is substantially similar to the first member 41. Therefore, a description of the second member 51 is omitted.

The cavity 33, as shown in FIG. 2, is formed when the first member 41 is connected to the second member 51 with the insulator assembly 11 received therebetween. The cavity 33 is defined by the outer surface 29 of the metal fitting and the outer surface 19 of the rubber housing 13 and the inner surfaces 46 and 56 of the first and second members 41 and 51. An upper boundary of the cavity 33 is defined by the intersection between the first and second lips 73 and 74 of the first and second members 41 and 51 with the outer surface 19 of the rubber housing 13. A lower boundary of the cavity 33 is defined by the intersection between the first and second ribs 71 and 73 of the first and second members 41 and 51 with the groove 23 of the metal fitting 21. Sealant 61 is injected through one of the first and second openings 47 and 57 to fill the cavity, thereby creating a seal between the collar assembly 31, rubber housing 13 and metal fitting 11.

Preferably, the first and second members 41 and 51 are made of a metal, which is preferably conductive, such as ductile iron or aluminum. Preferably, the sealant 61 is a room temperature or high temperature vulcanizing material.

Assembly and Operation

Referring to FIGS. 1–8, the first and second members 41 and 51 are secured together to form a collar assembly 31 having an aperture therethrough, which is adapted to receive an insulator assembly 11, as shown in FIGS. 1–3. The preferably arcuate first and second members form a substantially donut-shaped (or annular or toroidal) member when secured together having an aperture 35 therethrough. The aperture 35 is adapted to receive the insulator assembly 11.

The first end 15 of the rubber housing 13 is inserted in the open first end 25 of the metal fitting, as shown in FIG. 2. A gasket (not shown) may be disposed on a portion of the first end 15 of the rubber housing 13 received within the metal fitting 21 to create a seal therebetween.

The first member 41 is disposed on the insulator assembly 11 such that the first rib 71 is received by the groove 23 in the metal fitting 21. The second member 51 is disposed on the insulator assembly 11 adjacent the first member 41 such that the second rib 72 is received by the groove 23 in the metal fitting. The first end face 42 of the first member 41 abuts the fourth end face 54 of the second member 51. The second end face 44 of the first member 41 abuts the third end face 52 of the second member 51. The first and second ribs 71 and 72 form a substantially annular rib received in the circumferential groove 23 in the metal fitting 21. The first and second lips 73 and 74 form an annular lip encircling the outer surface 19 of the rubber housing 13.

A first fastener 81 is inserted through the second fastener hole 45 in the first member 41 and into the third fastener hole 53 in the second member 51. Preferably, the third fastener hole 53 is threaded to securely receive the first fastener 81 therein. Preferably, the second fastener hole 45 is counterbored to limit insertion of the first fastener 81.

A second fastener 83 is inserted through the fourth fastener hole 55 in the second member 51 and into the first fastener hole 43 in the first member 41. Preferably, the first fastener hole 43 is threaded to securely receive the second fastener 83 therein. Preferably, the fourth fastener hole 55 is counter-bored to limit insertion of the second fastener 83. The collar assembly 11 is then tightened in place on the insulator assembly 11 with the first and second fasteners 81 and 81 accessed through the second and fourth fastener holes accessible through the outer surfaces 48 and 58 of the first and second members 41 and 51.

Once the first and second members 41 and 51 have been secured on the insulator assembly 11, sealant 61 may be injected through either the first or second openings 47 and 57 to fill the cavity 33 with the sealant. Preferably, the sealant is injected in the first opening 47 until the sealant emerges from the second opening 57, which is preferably diametrically opposed to the first opening. The first and second lips 73 and 74 and the first and second ribs 71 and 72 form upper and lower boundaries to prevent passage of the sealant thereby. Disposing a gasket on the outer surface of the rubber housing received within the metal fitting prevents the sealant from leaking into the metal fitting. The collar assembly 11 acts like a mold, thereby creating a seal between the collar assembly 11, rubber housing 13 and metal fitting 21 once the sealant sets. The assembled corona assembly on the insulator assembly substantially eliminates corona discharge.

While a particular embodiment has been chosen to illustrate the invention, it will be understood by those skilled in the art that various changes and modifications may be made therein without departing from the scope of the invention as defined in the appended claims.

What is claimed is:

1. A collar assembly for an insulator assembly, comprising:

a first member having first and second fastener holes, first inner and outer surfaces and a first opening extending between said first inner and outer surfaces;

a second member connected to said first member, said second member having third and fourth fastener holes aligned with said first and second fastener holes, respectively, second inner and outer surfaces and a second opening extending between said second inner and outer surfaces, said first and second openings being adapted to convey a sealant; and a first fastener inserted through said first and third fastener holes and a second fastener inserted through said fourth and second fastener holes to secure said first member to said second member.

2. A collar assembly for an insulator assembly according to claim 1, wherein said first member is substantially similar to said second member.

3. A collar assembly for an insulator assembly according to claim 1, wherein said first and third fastener holes are threaded.

4. A collar assembly for an insulator assembly according to claim 1, wherein a cavity is formed between said first and second inner surfaces of said first and second members and an outer surface of the insulator assembly.

5. A collar assembly for an insulator assembly according to claim 4, wherein first and second openings are in fluid communication with said cavity.

6. A collar assembly for an insulator assembly according to claim 5, wherein said sealant injected through said first opening substantially fills said cavity.

7. A collar assembly for an insulator assembly according to claim 1, wherein said second and fourth fastener holes are counterbored.

8. A collar assembly for an insulator assembly according to claim 1, wherein said sealant is a room temperature or high temperature vulcanizing material.

9. A collar assembly for an insulator assembly according to claim 1, wherein said first and second members are made of a conductive metal.

10. A collar assembly for an insulator assembly according to claim 1, wherein first and second ribs extending outwardly from said first and second inner surfaces, respectively, are adapted to engage a groove in an outer surface of a metal fitting of the insulator assembly.

11. A collar assembly for an insulator assembly according to claim 1, wherein first and second lips extending outwardly from said first and second inner surfaces, respectively, are adapted to engage an outer surface of a rubber housing of the insulator assembly.

12. A collar assembly for an insulator assembly according to claim 1, wherein said cavity is formed between said first and second inner surfaces of said first and second members and the outer surfaces of the metal fitting and the rubber housing of the insulator assembly, said first and second lips and first and second ribs defining upper and lower boundaries of said cavity.

13. A collar assembly for an insulator assembly according to claim 12, wherein first and second openings are in fluid communication with said cavity, and said sealant is injected through one of said first and second openings to substantially fill said cavity.

14. A method of installing a collar assembly on an insulator assembly, comprising the steps of disposing a first member having first and second fastener holes and a first opening on the insulator assembly;

connecting a second member to the first member on the insulator assembly, the second member having third and fourth fastener holes aligned with the first and second fastener holes, respectively, and a second opening;

inserting a first fastener through the second and third fastener holes of the first and second members on the insulator assembly;

inserting a second fastener through the fourth and first fastener holes of the first and second members on the insulator assembly; and injecting a sealant through the first opening to fill the cavity formed between inner surfaces of the first and second members and an outer surface of the insulator assembly, the first and second openings being in fluid communication with the cavity.

15. A collar assembly for an insulator assembly according to claim 14, further comprising injecting the sealant until the sealant emerges from the second opening.

16. An insulator assembly, comprising:

a rubber housing having a first end;

a metal fitting having a first end, said first end of said rubber housing being disposed in said first end of said metal fitting;

a collar assembly disposed over said first ends of said rubber housing and said metal fitting, said collar assembly having an annular rib engaging a groove proximal said first end of said metal fitting and a lip engaging said rubber housing proximal said first end thereof, a cavity being defined by an inner surface of said collar assembly and an outer surface of said metal fitting and said rubber housing between said annular rib and said lip; and a sealant injected through said collar assembly to fill said cavity to create a seal between said collar assembly, said metal fitting and said rubber housing.

17. An insulator assembly according to claim 16, wherein said sealant is injected through a first opening in said collar assembly.

18. An insulator assembly according to claim 16, wherein substantially similar first and second members are fastened together to form the collar assembly.

19. An insulator assembly according to claim 18, wherein said sealant is injected through a first opening in said first member until said sealant emerges from a second opening in said second member.

20. A collar assembly for an insulator assembly according to claim 16, wherein said sealant is a room temperature or high temperature vulcanizing material.

* * * * *